US005551740A

United States Patent [19]

Lin et al.

[11] Patent Number: 5,551,740

[45] Date of Patent: Sep. 3, 1996

[54] RETAINING ASSEMBLY FOR RETAINING RELEASABLY A DOOR AT A DESIRED OPEN POSITION TO A DOOR FRAME

[75] Inventors: San-Yi Lin, Yun-Lin Hsien; Song-Gen Shyu; Tong-Pei Wu, both of Chia-Yi Hsien, all of Taiwan

[73] Assignee: Tong-Lung Metal Industry Co., Ltd., Taiwan

[21] Appl. No.: 317,701

[22] Filed: Oct. 4, 1994

[51] Int. Cl.[6] ..... E05C 17/44

[52] U.S. Cl. ..... 292/338; 292/262

[58] Field of Search ..... 292/338, 262, 292/DIG. 19, DIG. 36; 16/82, 66, 49

[56] References Cited

U.S. PATENT DOCUMENTS

| | | | |
|---|---|---|---|
| 3,259,936 | 7/1966 | Sheridan | 16/49 |
| 3,909,877 | 10/1975 | Christy et al. | 16/49 X |
| 3,911,526 | 10/1975 | Christy et al. | 16/49 |
| 3,996,642 | 12/1976 | Atkins | 16/82 |
| 4,286,412 | 9/1981 | Stevens | 292/274 X |
| 4,803,754 | 2/1989 | Roberts | 16/49 |
| 4,878,265 | 11/1989 | Nesbitt | 16/49 |

*Primary Examiner*—Steven N. Meyers
*Assistant Examiner*—Monica Millner
*Attorney, Agent, or Firm*—Ladas & Parry

[57] ABSTRACT

A retaining assembly includes a hollow casing mounted on a door. The casing has a horizontal wall portion formed with a through-hole and an upright rotary shaft which has an end portion that extends out of the casing through the wall portion and which is rotatable relative to the casing. A coupling rod has a first end portion connected pivotally to a door frame and a second end portion connected to the end portion of the shaft so as to, drive rotatably the shaft in a first direction when the door moves relative to the door frame to an open position. A pin has an end portion which is normally biased to extend out of the casing via the through-hole. An elongated positioning plate has a first end portion and a second end portion which is coupled releasably and selectively to the end portion of the shaft such that the first end portion is displaced by a variable initial angle, corresponding to the open position, with respect to the pin when the door is in a closed position. The positioning plate is rotatable with the shaft in the first direction to a position where the pin engages the first end portion of the positioning plate by a friction force sufficient to arrest releasably rotation of the shaft in a second direction opposite to the first direction so as to retain releasably the door at the open position.

10 Claims, 5 Drawing Sheets

RETAINING ASSEMBLY FOR RETAINING RELEASABLY A DOOR AT A DESIRED OPEN POSITION TO A DOOR FRAME

BACKGROUND OF THE INVENTION

1. Field of the Invention

This invention relates to a retaining assembly, more particularly to a retaining assembly which is used to retain a door at a desired open position relative to a door frame.

2. Description of the Related Art

Generally, a conventional retaining assembly for a door is used with a conventional hydraulic door closing system which normally biases the door to return to a closed position when the door is opened relative to a door frame. The conventional retaining assembly is capable of overcoming the biasing force provided by the hydraulic door closing system to retain releasably the door at a predetermined open position, wherein the door and the door frame cooperatively form a predetermined angle therebetween, such as 80 degrees or 170 degrees. However, the predetermined angle is fixed and cannot be varied. Thus, there is a need to provide a retaining assembly which can retain releasably a door at a desired open position relative to a door frame.

SUMMARY OF THE INVENTION

Therefore, the main objective of the present invention is to provide a retaining assembly which is simple in construction and which can retain releasably a door at a desired open position relative to a door frame.

According to the present invention, a retaining assembly for retaining releasably a door at a desired open position relative to a door frame includes a hollow casing which is adapted to be mounted on one of the door and the door frame and which has a horizontal wall portion that is formed with a through-hole. The casing further has an upright rotary shaft which is connected rotatably thereto and which has an end portion that extends out of the casing through the wall portion. The rotary shaft is rotatable relative to the casing. A coupling rod has a first end portion which is connected pivotally to the other one of the door and the door frame and a second end portion which is connected to the end portion of the rotary shaft. The coupling rod drives rotatably the rotary shaft in a first direction when the door moves relative to the door frame to the desired open position. A spring-loaded pin unit is disposed in the casing and includes a pin which has an end portion that is normally biased to extend out of the casing via the through-hole. A stop unit includes an elongated positioning plate which has a first end portion and a second end portion. The stop unit further includes means for coupling releasably and selectively the second end portion of the positioning plate to the end portion of the rotary shaft such that the first end portion is displaced by a variable initial angle, corresponding to the desired open position, with respect to the pin when the door is in a closed position. The positioning plate is rotatable with the rotary shaft in the first direction to a position where the pin engages the first end portion of the positioning plate by a friction force sufficient to arrest releasably rotation of the rotary shaft in a second direction opposite to the first direction so as to retain releasably the door at the desired open position.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
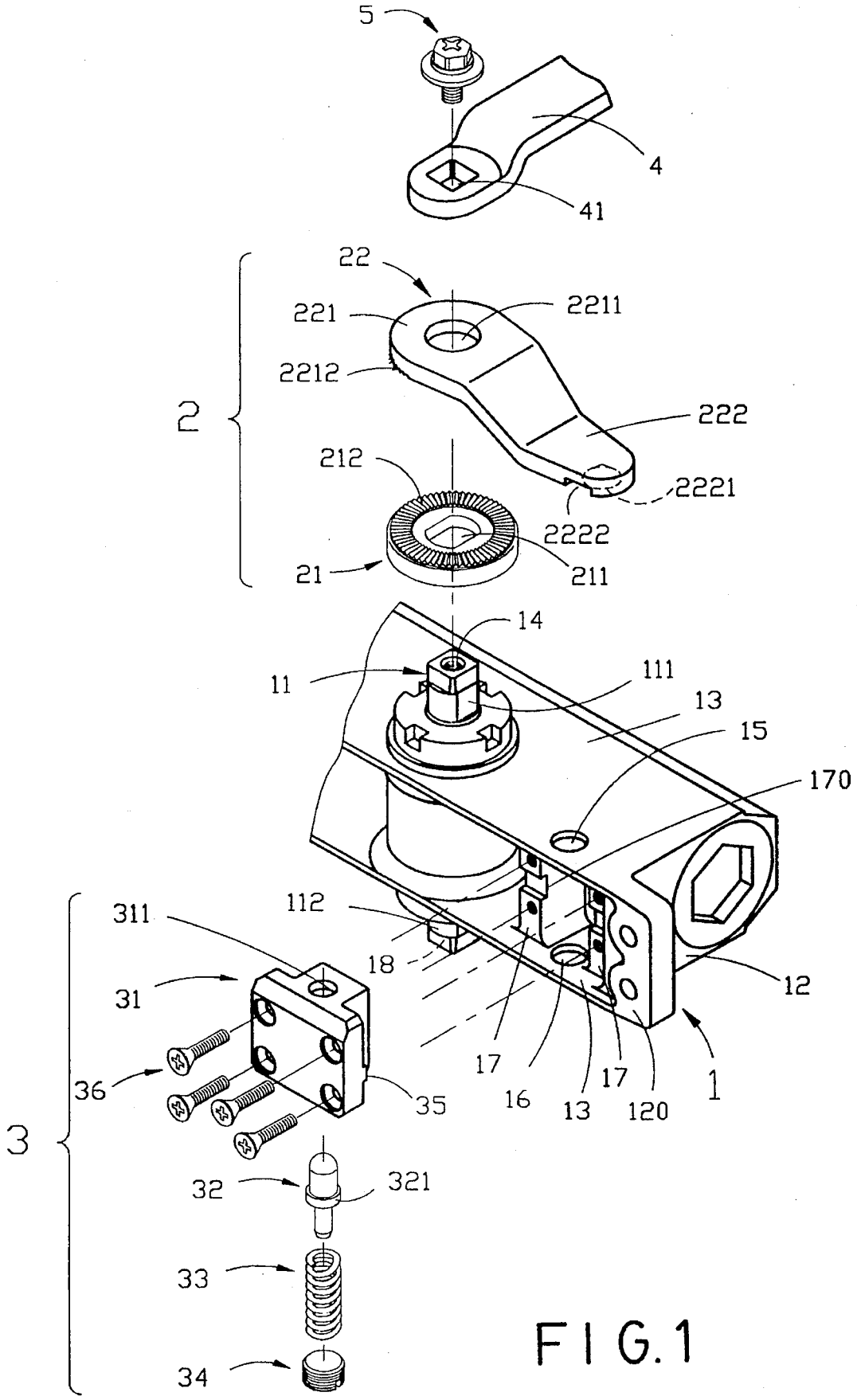
FIG. 1 is a schematic exploded view showing a retaining assembly according to the present invention.
Figure 2:
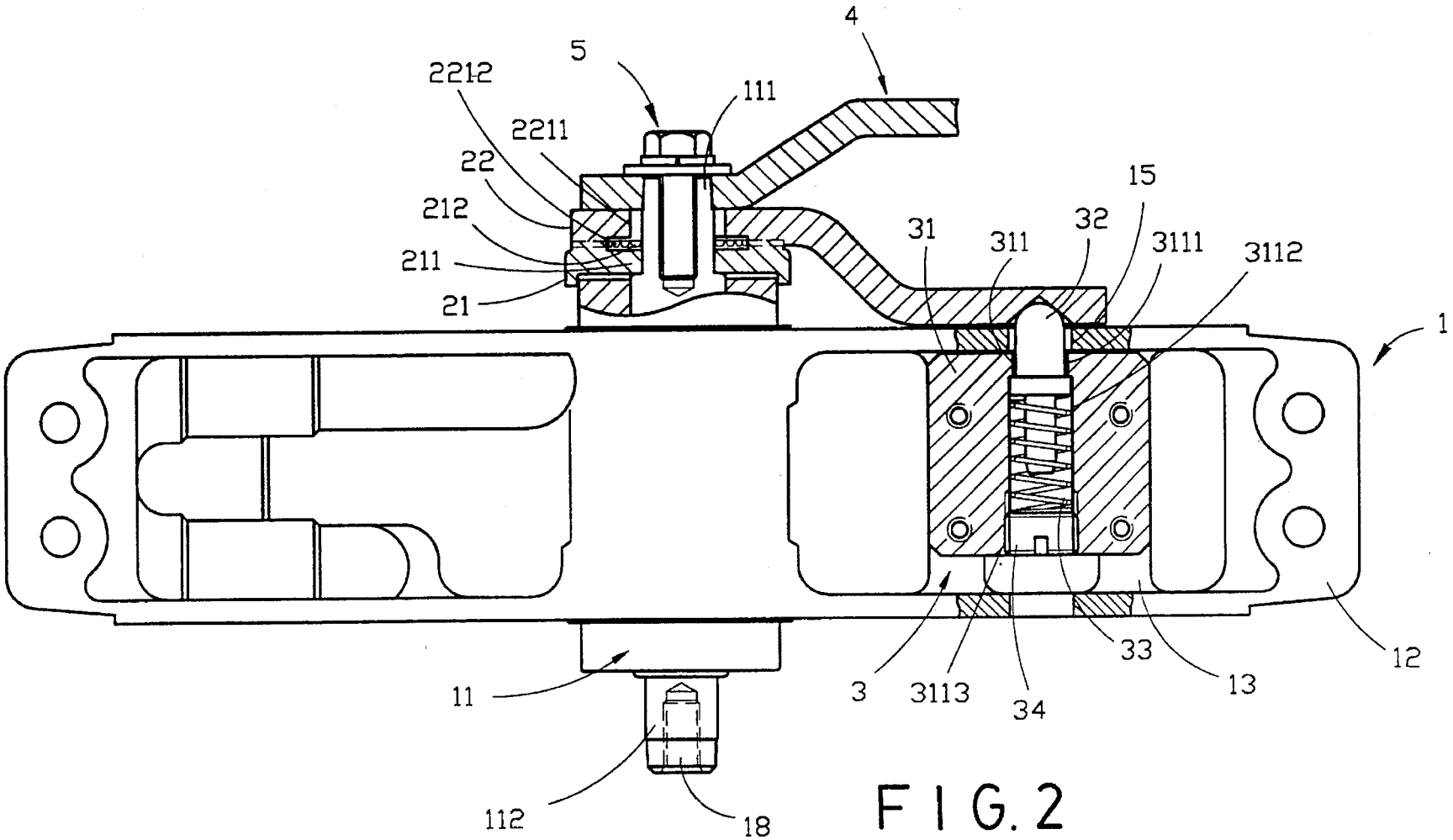
FIG. 2 is a partly sectional view showing the assembled retaining assembly according to the present invention.
Figure 5:
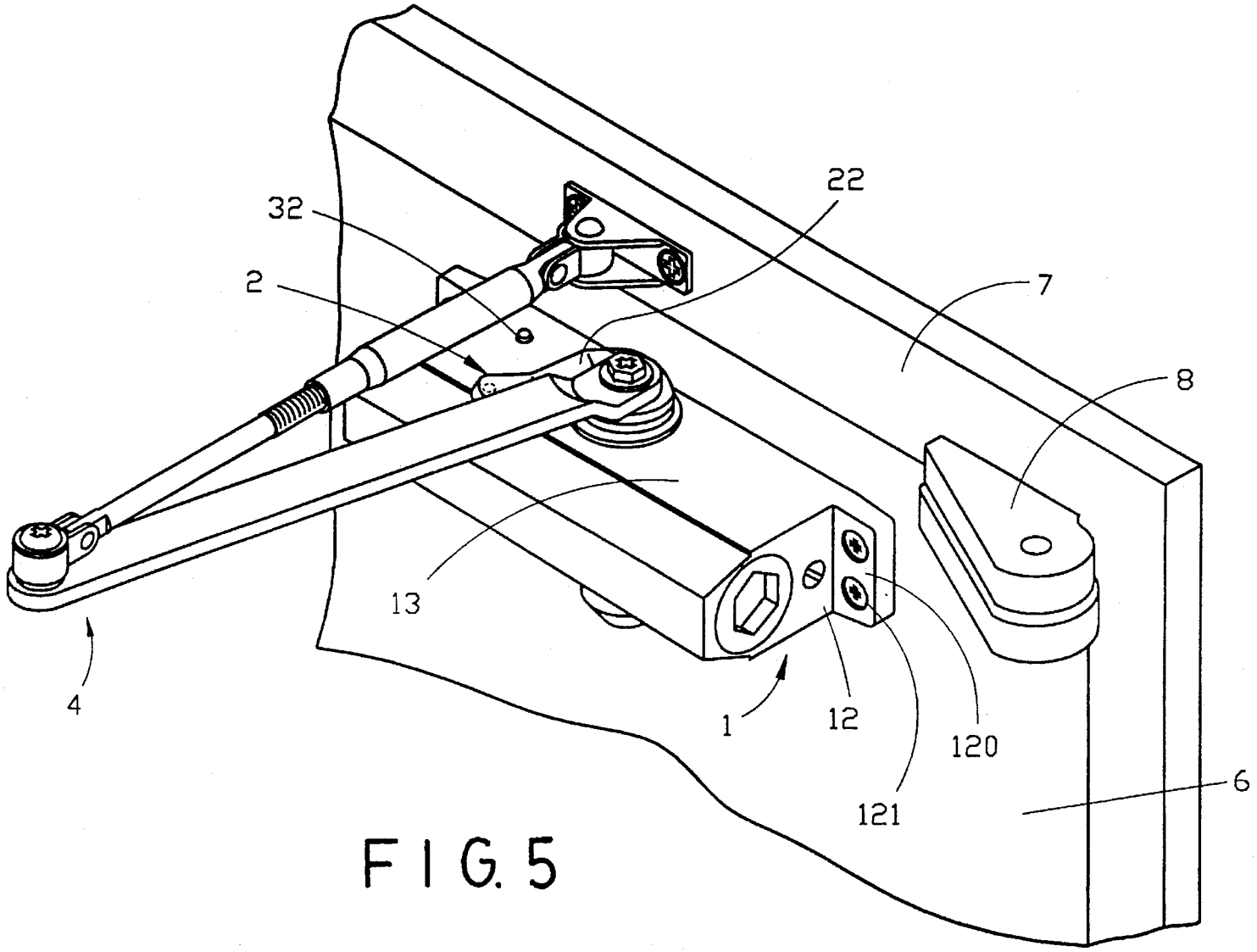
FIG. 5 is a schematic perspective view showing the retaining assembly according to the present invention when in use.

Referring to FIGS. 1, 2 and 5, in accordance with the present invention, a retaining assembly for retaining releasably a door 6 at a desired open position relative to a door frame 7 includes a hollow casing 1, a coupling rod 4, a spring-loaded pin unit 3 and a stop unit 2.

The hollow casing 1 includes two opposite horizontal wall portions 13 which are interconnected by two opposite vertical wall portions 12 (just one is shown in FIG. 1). Each of the wall portions 12 has a mounting tab 120 which extends outwardly therefrom. The casing 1 is mounted on the door 6 by means of locking bolts 121 which extend through the mounting tabs 120 and into the door 6. Two opposed vertical mounting plates 17 extend between the horizontal wall portions 13 and are formed with aligned positioning grooves 170. Each of the horizontal wall portions 13 is formed with a through-hole 15,16. The through-holes 15,16 are aligned with each other and are located between the mounting plates 17. An upright rotary shaft 11 is connected rotatably to the casing 1 and is associated operably with a conventional hydraulic door closing system (not shown) which functions as described above. Since the association between the upright rotary shaft 11 and the conventional hydraulic door closing system is known and is not related to the present invention, a detailed description thereof is thus omitted. The upright rotary shaft 11 has two end portions 111,112 which extend out of the casing 1 through the respective horizontal wall portions 13. Two connecting nuts 14,18 are connected coaxially and respectively to the end portions 111,112 of the rotary shaft 11.

The coupling rod 4 has a first end portion which is connected pivotally to the door frame 7 in a known manner and a second end portion which is formed with a mounting hole 41 that engages fittingly the connecting nut 14 so as to drive rotatably the rotary shaft 11 when the door 6 moves relative to the door frame 7.

The spring-loaded pin unit 3 includes a mounting block 31 which has a connecting portion secured to the mounting plates 17 by means of locking bolts 36 that extend through the connecting portion and into the mounting plates 17. The mounting block 31 further has an insert portion which is located between the mounting plates 17 when the mounting block 31 is secured to the mounting plates 17 and which is formed with a vertically extending through-bore 311 that is aligned with the through-holes 15,16 of the horizontal wall portions 13 of the casing 1. The through-bore 311 has a diameter-reduced portion 3111 which is located adjacent the through-hole 15, an internally threaded portion 3113 which is located opposite to the through-hole 15 and a diameter-increased portion 3112 which is located between the diameter-reduced portion 3111 and the internally threaded portion 3113. A pin 32 is disposed within the through-bore 311 and has a radially extending flange 321 projecting therefrom. The diameter-reduced portion 3111 is sized to permit extension of the end portion of the pin 32 through the through-hole 311 while preventing extension of the flange 321 of the pin 32 through the through-hole 311. A threaded rod 34 is connected threadably to the mounting block 31 by the extension thereof into the internally threaded portion 3113 of the through-bore 311. A spring 33 is located in the diameter-increased portion 3112 of the through-bore 311 between the flange 321 of the pin 32 and the threaded rod 34 so as to normally bias the end portion of the pin 32 to extend out of the casing 1 via the through-hole 15. A positioning rib 35 projects from the connecting portion of the mounting block 31 on two sides of the insert portion of the mounting block 31 and is received in the positioning groove 170 of a respective mounting plate 17 so as to further position the mounting block 31.

The stop unit 2 includes a circular plate 21 which is formed with a central hole 211 through which the end portion of the rotary shaft 11 extends fittingly. The circular plate 21 has a top surface which is formed with a plurality of angularly spaced engaging teeth 212. An elongated positioning plate 22 has a first end portion 222 which has a bottom surface formed with a conical positioning blind bore 2221 and two opposed guiding grooves 2222 which extend on two sides of a longitudinal axis of the first end portion 222 of the positioning plate 22. The positioning plate 22 further has a second end portion 221 which is formed with an engaging hole 2211 through which the end portion of the rotary shaft 11 extends rotatably. The second end portion 221 of the positioning plate 22 has a bottom surface formed with a plurality of angularly spaced engaging teeth 2212 which mesh releasably with the teeth 212 of the circular plate 21.

Referring to FIGS. 1 to 5, during assembly, the pin 32 and the spring 33 are received respectively within the diameter-reduced and the diameter-increased portions 3111,3112 of the through-bore 311 of the mounting block 31. The threaded rod 34 extends threadably into the threaded portion 3113 of the through-bore 311 so as to retain the pin 32 and the spring 33 within the through-bore 311. The mounting block 31 is secured to the mounting plates 17 such that the end portion of the pin 32 is biased to extend out of the casing 1 through the through-hole 15. The casing 1 is secured to the door 6 by means of locking bolts 121. The circular plate 21 and the positioning plate 22 engage the end portion 111 of the rotary shaft 11. At this time, the door 6 should have been moved to a desired open position, wherein the door 6 and the door frame 7 cooperatively define a desired angle ($\alpha$) therebetween. The blind bore 2221 engages the end portion of the pin 32, and the teeth 2212 mesh with the teeth 212 of the circular plate 21 after the door 6 is located at the desired open position. Then, the mounting hole 41 of the coupling rod 4 engages fittingly the connecting nut 14. Finally, a locking bolt 5 extends through the mounting hole 41 and engages threadably the connecting nut 14 so as to prevent disengagement of the coupling rod 4 from the connecting nut 14. At this time, the door 6 is retained at the desired open position relative to the door frame 7 (see FIG. 3). Since the blind bore 2221 is defined by an inclined peripheral wall, and since the positioning plate 22 rotates with the rotary shaft 11 relative to the door 6 when the door 6 moves relative to the door frame 7, the end portion of the pin 32 can be pressed to retract into the through-bore 311 so as to disengage the blind bore 2221 when the door 6 is forced to move relative to the door frame 7.

Figure 3:
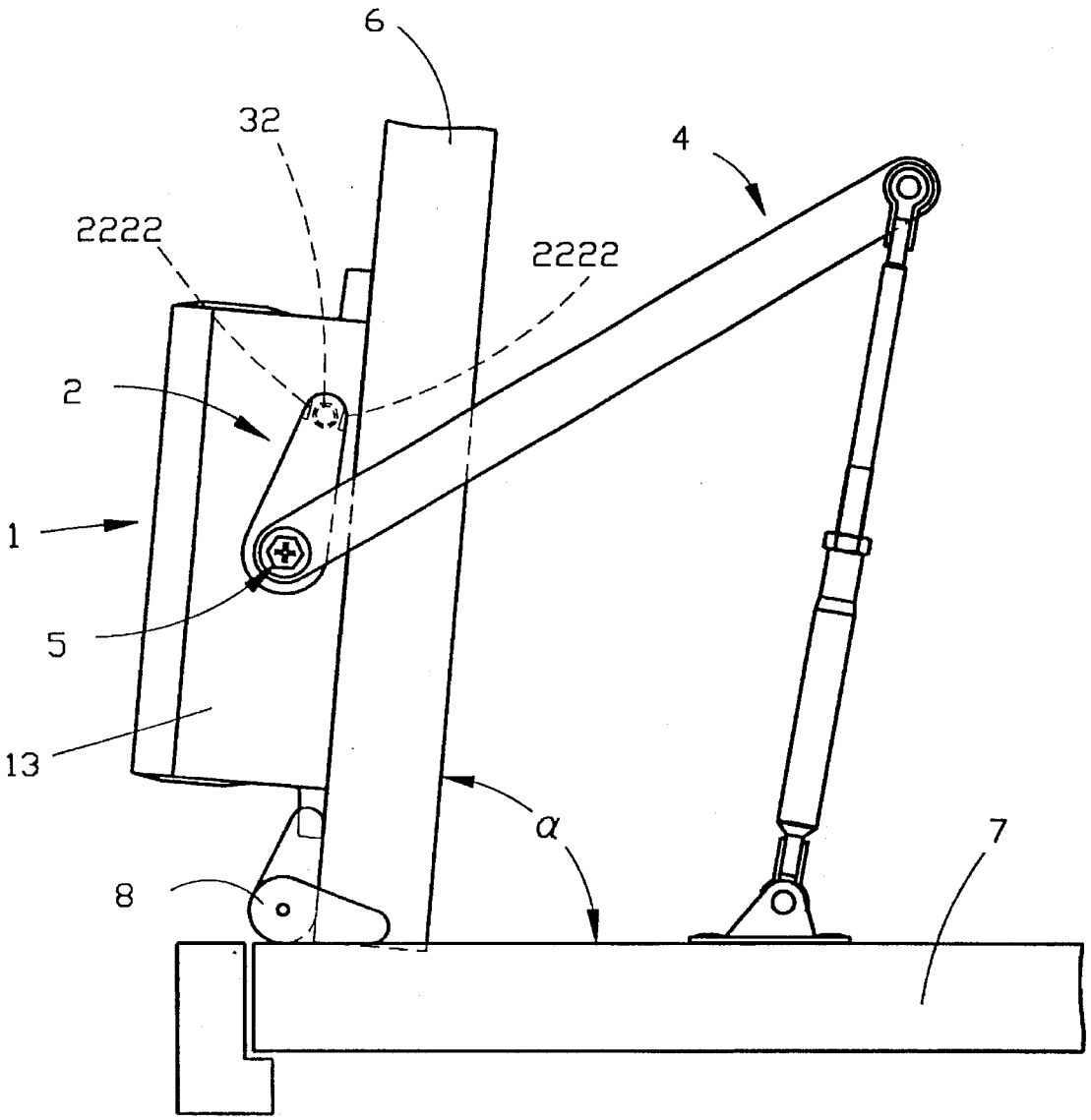
FIG. 3 is a schematic top view of the assembled retaining assembly according to the present invention when in use.
Figure 4:
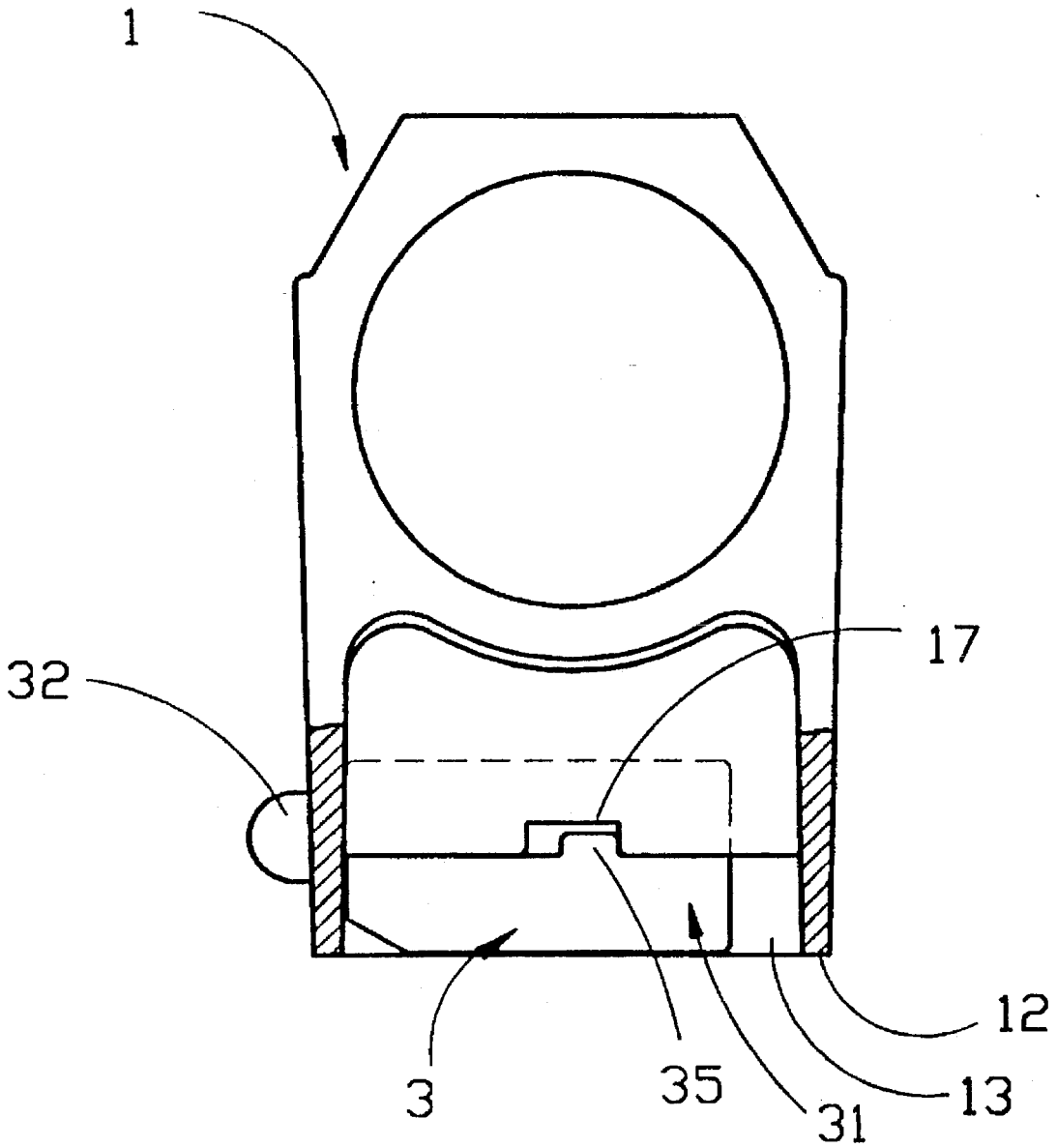
FIG. 4 is another partly sectional view showing the assembled retaining assembly according to the present invention.

Referring now to FIGS. 2, 3 and 5, in operation, supposing the door 6 is initially in a closed position (see FIG. 5), the blind bore 2221 of the positioning plate 22 is displaced angularly from the end portion of the pin 32. The coupling rod 4 drives rotatably the rotary shaft 11 in a first direction so as to result in rotation of the positioning plate 22 in the same direction in order to move the first end portion 222 of the positioning plate 22 toward the pin 32 when the door 6 moves from the closed position to the desired open position (see FIG. 3) relative to the door frame 7. The end portion of the pin 32 is received within one of the guiding grooves 2222 when the door 6 moves to a position where the first end portion 222 of the positioning plate 22 is adjacent to the pin 32. The guiding groove 2222 guides the end portion of the pin 32 into the positioning blind bore 2221 when movement of the door 6 continues until the desired open position is reached, thereby overcoming a biasing force provided by the conventional hydraulic door closing system so as to prevent rotation of the rotary shaft 11 in a second direction opposite to the first direction in order to retain the door 6 at the desired open position. It should be noted that forced further movement of the door 6 results in the release of the door 6 from the desired open position.

When it is desired to retain the door 6 at a new desired open position, wherein the angle ($\alpha$) formed between the door 6 and the door frame 7 is varied, the door 6 is initially moved to the new desired open position. The locking bolt 5 is released so as to permit the disengagement of the teeth 2212 of the positioning plate 22 from the teeth 212 of the circular plate 21. Then, the positioning plate 22 is rotated relative to the rotary shaft 11 to a position where the positioning blind bore 2221 is aligned with and engages the end portion of the pin 32. Finally, the locking bolt 5 once more engages the nut 14. At this time, the door 6 can be retained at the new desired open position when the door 6 reaches the new desired open position.

It should be noted that the force for biasing the pin 32 to extend out of the casing 1 can be adjusted by the use of a screw driver (not shown) which is to be extended through the through-hole 16 for driving the threaded rod 34 to rotate. Rotation of the threaded rod 34 results in longitudinal movement thereof toward and away from the pin 32.

It should also be noted that the casing 1 can be mounted on an opposite side of the door 6. When the casing 1 is mounted on the opposite side of the door 6, the casing 1 must be inverted, that is, the through-hole 16 is located above the through-hole 15. At this time, the circular plate 21 and the positioning plate 22 engage the end portion 112 of the rotary shaft 11, while the mounting hole 41 of the coupling rod 4 engages the nut 18. The locking bolt 5 engages threadably the nut 18 so as to prevent disengagement of the coupling rod 4 from the connecting nut 18. The end portion of the pin 32 extends through the casing 1 via the through-hole 16, and the force for biasing the pin 32 to extend out of the casing 1 can be adjusted by the use of a screw driver which is to be extended through the through-hole 15 so as to drive rotatably the threaded rod 34.

We claim:

1. A retaining assembly for retaining releasably a door at a desired open position of a plurality of selectable open positions relative to a door frame, said retaining assembly comprising:

a hollow casing which is adapted to be securely mounted on said door frame and which has a horizontal wall portion that is formed with a through-hole, said casing further having an upright rotary shaft which is connected rotatably thereto and which has an end portion extends out of said casing through said horizontal wall portion, said rotary shaft being rotatably relative to said casing;

a coupling rod having a first end portion adapted to be connected pivotally to said door and a second end portion connected to said end portion of said rotary shaft, said coupling rod driving rotatably said rotary shaft in a first direction when said door moves relative to said door frame to said desired open position;

a spring-loaded pin unit which is disposed in said casing and which includes pin having an end portion that is normally biased to extend out or said casing via said through-hole; and a stop unit including an elongated positioning plate which has a first end portion and a second end portion, and means for coupling releasably and selectively said second end portion of said positioning plate to said end portion of said rotary shaft, said coupling means including an angle setting plate being cooperative with the second end portion of the positioning plate for selectively displacing said first end portion at one of variable initial angles, corresponding to said desired open position, with respect to said pin when said door is in a closed position, said positioning plate being rotatable with said rotary shaft in said first direction to a position where said pin engages said first end portion of said positioning plate by a friction force sufficient to arrest releasably rotation of said rotary shaft in a second direction opposite to said first direction so as to retain releasably said door at said desired open position.

2. A retaining assembly as claimed in claim 1, wherein said first end portion of said positioning plate has a bottom surface which is formed with a conical positioning blind bore, said end portion of said pin being received in said positioning blind bore to retain releasably said door at said desired open position.

3. A retaining assembly as claimed in claim 2, wherein said pin of said spring-loaded pin unit has a radially extending flange projecting therefrom, said spring-loaded pin unit further including a mounting block disposed securely in said casing and formed with a vertically extending through-bore within which said pin is slidably received, said through-bore being aligned with said through-hole of said wall portion of said casing and having a diameter-reduced portion adjacent said through-hole, said diameter-reduced portion of said through-bore being sized to permit extension of said end portion of said pin through said through-hole while preventing extension of said flange of said pin through said through-hole, said spring-loaded pin unit further including a threaded rod connected threadably to said mounting block and located opposite to said diameter-reduced portion, and a spring interposed between said flange of said pin and said threaded rod so as to normally bias said end portion of said pin to extend out of said casing via said through-hole.

4. A retaining assembly as claimed in claim 2, wherein said bottom surface of said first end portion of said positioning plate is formed with two opposed guiding grooves which extend on two sides of a longitudinal axis of said first send portion of said positioning plate to guide said pin into said positioning blind bore.

5. A retaining assembly as claimed in claim 1, wherein said angle setting plate of said coupling means of said stop unit includes a circular plate formed with a central hole through which said end portion of said rotary shaft extends fittingly, said circular plate having a top surface which is formed with a plurality of angularly spaced engaging teeth, said second end portion of said positioning plate being formed with an engaging hole through which said end portion of said rotary shaft extends rotatably and having a bottom surface formed with a plurality of angularly spaced engaging teeth which mesh releasably with said teeth of said circular plate.

6. A retaining assembly for retaining releasably a door at a desired open position of a plurality of selectable open positions relative to a door frame, said retaining assembly comprising:

A hollow casing which is adapted to be securely mounted on said door and which has a horizontal wall portion that is formed with a through-hole, said casing further having an upright rotary shaft which is connected rotatably thereto and which has an end portion that extends out of said casing through said horizontal wall portion, said rotary shaft being rotatably relative to said casing;

a coupling rod having a first end portion adapted to be connected pivotally to said door frame and second end portion adapted to be connected to said end portion of said rotary shaft, said coupling rod driving rotatably said rotary shaft in a first direction when said door moves relative to said door frame to said desired open position;

a spring-loaded pin unit which is disposed in said casing and which includes a pin having an end portion that is normally biased to extend out of said casing via said through-hole; and a stop unit including and elongated positioning plate which has a first end portion and a second end portion, and means for coupling releasably and selectively said second end portion of said positioning plate to said end portion of said rotary shaft, said coupling means including an angle setting plate being cooperative with the second end portion of the positioning plate for selectively displacing said first end portion at one of variable initial angles, corresponding to said desired open position, with respect to said pin when said door is in a closed position, said positioning plate being rotatable with said rotary shaft in said first direction to a position where said pin engages said first end portion of said positioning plate by a friction force sufficient to arrest releasably rotation of said rotary shaft in a second direction opposite to said first direction so as to retain releasably said door at said desired open position.

7. A retaining assembly as claimed in claim 6, wherein said first end portion of said positioning plate has a bottom surface which is formed with a conical positioning blind bore, said end portion of said pin being received in said positioning blind bore to retain releasably said door at said desired open position.

8. A retaining assembly as claimed in claim 7, wherein said pin of said spring-loaded pin unit has a radially extending flange projecting therefrom, said spring-loaded pin unit further including a mounting block disposed securely in said casing and formed with a vertically extending through-bore within which said pin is slidably received, said through-bore being aligned with said through-hole of said wall portion of said casing and having a diameter-reduced portion adjacent said through-hole, said diameter-reduced portion of said through-bore being sized to permit extension of said end portion of said pin through said through-hole while preventing extension of said flange of said pin through said through-hole, said spring-loaded pin unit further including a threaded rod connected threadably to said mounting block and located opposite to said diameter-reduced portion, and a spring interposed between said flange of said pin and said threaded rod so as to normally bias said end portion of said pin to extend out of said casing via said through-hole.

9. A retaining assembly as claimed in claim 7, wherein said bottom surface of said first end portion of said positioning plate is formed with two opposed guiding grooves which extend on two sides of a longitudinal axis of said first end portion of said positioning plate to guide said pin into said positioning blind bore.

10. A retaining assembly as claimed in claim 7, wherein said angle setting plate of said coupling means of said stop unit includes a circular plate formed with a central hole through which said end portion of said rotary shaft extends fittingly, said circular plate having a top surface which is formed with a plurality of angularly spaced engaging teeth, said second end portion of said positioning plate being formed with an engaging hole through which said end portion of said rotary shaft extends rotatably and having a bottom surface formed with a plurality of angularly spaced engaging teeth which mesh releasably with said teeth of said circular plate.

* * * * *